United States Patent [19]

Gilles et al.

[11] Patent Number: 4,614,526

[45] Date of Patent: Sep. 30, 1986

[54] DUST COLLECTOR WITH IMPROVED COLLECTING ELECTRODES

[75] Inventors: Helmut Gilles; Wilhelm Leussler, both of Frankfurt am Main, Fed. Rep. of Germany

[73] Assignee: Metallgesellschaft Aktiengesellschaft, Frankfort am Main, Fed. Rep. of Germany

[21] Appl. No.: 708,740

[22] Filed: Mar. 6, 1985

[30] Foreign Application Priority Data

Mar. 10, 1984 [DE] Fed. Rep. of Germany ..... 3408839

[51] Int. Cl.[4] ..... B03C 3/36; B03C 3/45

[52] U.S. Cl. ..... 55/130; 55/137; 55/145; 55/156

[58] Field of Search ..... 55/130, 137, 143, 145, 55/156, 154

[56] References Cited

U.S. PATENT DOCUMENTS

| | | | |
|---|---|---|---|
| 3,282,029 | 11/1966 | Steuernagel | 55/130 X |
| 3,362,135 | 1/1968 | Steuernagel et al. | 55/130 |
| 3,793,804 | 2/1974 | Steuernagel | 55/130 X |
| 4,007,023 | 2/1977 | Batza et al. | 55/137 X |
| 4,058,377 | 11/1977 | Schminke et al. | 55/156 X |
| 4,263,023 | 4/1981 | Schminke | 55/130 X |

FOREIGN PATENT DOCUMENTS

| | | | |
|---|---|---|---|
| 83347 | 3/1921 | Austria | 55/130 |
| 277400 | 12/1969 | Austria . | |
| 0014273 | 8/1980 | European Pat. Off. . | |
| 316703 | 12/1919 | Fed. Rep. of Germany . | |
| 1107203 | 5/1961 | Fed. Rep. of Germany . | |
| 1848928 | 12/1961 | Fed. Rep. of Germany . | |
| 1851222 | 5/1962 | Fed. Rep. of Germany . | |
| 1869720 | 4/1963 | Fed. Rep. of Germany . | |
| 1407529 | 12/1968 | Fed. Rep. of Germany . | |
| 1771478 | 12/1971 | Fed. Rep. of Germany . | |
| 3320360 | 1/1984 | Fed. Rep. of Germany . | |
| 2126068 | 10/1972 | France . | |
| 138721 | 1/1953 | Sweden | 55/130 |
| 486920 | 4/1970 | Switzerland . | |
| 374145 | 6/1932 | United Kingdom | 55/130 |
| 721158 | 12/1954 | United Kingdom | 55/154 |

*Primary Examiner*—Kathleen J. Prunner

*Attorney, Agent, or Firm*—Karl F. Ross; Herbert Dubno

[57] ABSTRACT

Collecting electrodes extend vertically in dust-collecting electrostatic precipitators, which are horizontally traversed by gas. Each collecting electrode comprises a plurality of profiled sheet metal strips which are suspended from the roof structure and are hooked into each other at their vertical longitudinal edges. The collecting electrodes also comprise at least one lower transverse connector. Two adjacent collecting electrodes define a gas passage which contains centrally disposed corona electrodes. Each sheet metal strip is substantially W-shaped in cross-section defining shallow dust-collecting pockets and comprises portions which are inclined alternately in opposite directions with respect to the direction of gas flow and portions which are parallel to the direction of gas flow and disposed between the inclined portions. The edge portions extend also parallel to the direction of gas flow and are reversely bent through 180° at their extreme ends to form U-shaped strips which are adapted to be hooked into each other.

5 Claims, 3 Drawing Figures

DUST COLLECTOR WITH IMPROVED COLLECTING ELECTRODES

FIELD OF THE INVENTION

The present invention relates to an electrostatic dust collector with improved collecting electrodes and, more specifically, to dust-collecting electrodes assembled from profiled sheet metal strips which are substantially W-shaped in cross-section to form vertically suspended collecting electrodes which, in the dust-collecting electrostatic precipitator, define gas passages adapted to be traversed by gas in a horizontal direction.

BACKGROUND OF THE INVENTION

It is known to use such sheet metal strips and such collecting electrodes in dry-process dust-collecting electostatic precipitators.

In many cases, such electrodes define alternating or symmetrically disposed dust-collecting pockets (see German Patent Publication DE-AS 11 07 203, German Utility Model DE-GM No. 18 48 928) and the electrodes are often so designed on their vertical longitudinal edges that consecutive sheet metal strips can be hooked into each other (see published German Application No. DE-OS No. 17 71 478, German Utility Model DE-GM No. 18 51 222, German Utility Model DE-GM No. 18 69 720, Austrian Patent No. 277,400 and Swiss Patent No. 486,920).

Some of the known collecting electrodes are positively connected directly to a rapping mechanism (German Utility Model DE-GM No. 18 51 222) so that the linkage of this mechanism constitutes a transverse connector.

Other pertinent details of prior art systems have been disclosed in the following printed publications: German Patent Specification No. 316,703, published German Application No. 14 07 529, published German Application No. 33 20 360, European Patent Specification No. 14,273, French Patent Specification No. 21 26 068 and U.S. Pat. No. 3,282,029.

The known sheet metal strip collecting electrodes have various disadvantages. For instance, the collecting electrodes disclosed in German Patent Publication DE-AS No. 11 07 203 comprise pairs of profiled sheet metal strips which have been joined by welding. The profiled sheet metal strips which have been cold-worked may be distorted during the welding operations and this distortion may result in a change of dimensions particularly if the strips are very long.

Such changes of dimensions cannot be tolerated where the spacing from the corona electrodes is to be precisely predetermined.

Another disadvantage of many known collecting electrodes is that dust-collecting pockets can be provided only on one side of each corona electrode so that the corona electrodes need be provided with corona tips only on one side.

In that case the dust will be less efficiently collected on those collecting electrode surface areas which do not face a corona tip and, when the collecting electrodes are cleaned by being rapped, the less efficient surface portions will cause a raising of a substantial portion of the dust that has already been collected. A large part of the dust thus released will be entrained with the gas stream so that the efficiency of the dust collector will be reduced.

In addition, the electrostatic precipitator must be assembled with great care because the corona tips must exactly be aligned with the dust-collecting pockets since an inadequate alignment of the corona tips will necessarily result in a reduction of the dust-collecting rate to a fraction of the normal rate.

Some of the disadvantages described hereinbefore have been avoided with the collecting electrode disclosed in German Utility Model DE-GM No. 18 48 928. But even with these electrodes two successive electrode strips are simply hooked into each other in a less-than-positive connection. In addition the sectional shape of the profiled strips does not permit them to be positively connected directly to the rapping linkage. Finally, the dust-collecting pockets have depths which are rather small in relation to their width so that the rapping may release a large part of the previously collected dust and the raised dust can be entrained by the gas stream. That effect is particularly significant at the last electrode strips of a dust collector because dust released here cannot be subsequently collected so that the dust content of the pure gas will be increased.

The collecting electrodes disclosed in published German Application DE-OS No. 17 71 478 also have most of the disadvantages which have been mentioned. In these electrodes it is highly undesirable that each sheet metal strip define only a single dust-collecting pocket and that adjacent strips can be hooked one into the other at their vertical longitudinal edges only if the profiled strip is made to very small tolerances in that region. This is hardly practicable in the manufacture of conventional sheet metal strips which can have lengths of up to 15 meters. As a result, it is difficult to assemble the strips and these difficulties can be avoided only if high costs are incurred; nevertheless, the results are often unsatisfactory.

The substantial deformation of the material as it is given by its profiled shape is a major disadvantage of the collecting electrodes disclosed in German Utility Model DE-GM No. 18 51 222, German Utility Model DE-GM No. 18 69 720 and Austrian Patent No. 277,400.

Such high-degree deformation will inevitably result in work hardening, which when the electrodes have been in operation for a prolonged time will give rise to the formation of cracks under the dynamic stresses due to the rapping blows applied to clean the electrodes.

While the electrode stips disclosed in the latter publications can be positively connected at their lower end to the rapping linkage, as is shown in German Utility Model No. 18 51 222, the hooked joints between the vertical longitudinal edges of adjacent electrodes are not adequate for a prolonged operation involving temperature fluctuations, particularly if the electrodes have the abovementioned large lengths that are usually prevalent.

The approaches used in the remaining above-mentioned publications also have failed to provide fully satisfactory collecting electrodes and collecting conditions.

Extensive investigations have shown that a considerable number of controlling parameters conflicting with each other must be properly selected for a fully effective collecting electrode.

For instance, the depth of the dust-collecting pockets must be so large that said pockets can form low-flow regions which are substantially free from the influence of the gas stream in operation so that dust will be effectively collected, but yet the raising of dust by the rapping blows applied to clean the collecting electrodes will be minimized.

However, with given overal flow cross sections the velocity of the gas flow increases as the flow cross section is decreased by deeper dust-collecting pockets. But this will necessarily result in a higher pressure drop and will give rise to the danger that the optimum velocity of flow of the gas cannot be maintained and the dust-collecting rate is reduced.

Moreover, the collecting electrodes should ensure that the flow density distribution will be as uniform as possible. In the most ideal case this is achieved with tubular collecting electrodes and centrally disposed corona electrodes, and it is desirable to approach this effect with plate-like collecting electrodes.

Finally, the sheet metal strips for the collecting electrodes should be suitable for an economical manufacture and should not have strongly profiled portions which are susceptible to stress corrosion. Besides, they should have a satisfactory relation between the effective collecting surface area and the expenditure of material and should be adapted to be assembled, repaired and replaced easily.

OBJECTS OF THE INVENTION

It is, therefore, the principal object of the invention to provide improved collecting electrodes for electrostatic precipitators which meet all of the requirements stated hereinbefore at comparatively low cost with optimum dust-collecting rates.

Another object is to provide for this purpose a sheet metal strip which as such a cross-sectional shape that the profiled strip can easily be shaped with high dimensional accuracy and which in dependence on the entrance width of the sheet metal strips or of the profiling plant permits a provision of any desired number of dust-collecting pockets in a row and an optimum distribution of the electric field to be achieved and also enables the formation of reliable hooked joints between adjacent sheet metal strips at their vertical longitudinal edges.

Yet another object is to provide for such collectors electrodes adapted to define wide gas passages and to constitute fields having a height of and above 15 meters, having a high degree of stiffness in their transverse and longitudinal directions, and being suitable for fast assembling without difficulty.

Finally, it is an object to provide an electrostatic precipitator whose electrodes are formed from sheet metal strips adapted to be positively connected at their lower ends directly to a rapping linkage and so shaped that the requirements from the aspects of flow dynamics, optimum flux line distribution and vibrational behavior during rapping are met.

SUMMARY OF THE INVENTION

These objects are accomplished in accordance with the invention by the provision of profiled sheet metal strips which are substantially W-shaped in cross-section and are characterized in combination by the fact that:

(a) the strips comprise portions which are inclined alternately in opposite directions wih respect to the direction of gas flow, and between these inclined portions comprise portions extending parallel to the direction of gas flow, (b) the end or edge portions of the strips are also parallel to the direction of gas flow and at their ends are reversely bent to form U-shaped hook strips which are hooked to adjoining strips, (c) the angle between the inclined portions and the parallel portions (measured at the interior of the bend) of the sheet metal strips is at least 150°, (d) the prependicular distance between those portions which are parallel to the direction of gas flow is 8 to 13% of the center spacing between two adjacent collecting electrode walls, (e) the center distance of two consecutive apices or crests facing in the same direction or turned toward the same side is 40 to 70% of the center spacing of two adjacent collecting electrode walls, (f) each parallel portion which is disposed between two inclined portions has a width amounting to 8 to 13% of the center spacing of two apices facing in the same direction, (g) the reversely bent end portion defines a clearance or gap between the shanks of the U which is four to five times the thickness of the sheet metal strip, and (h) the overall length of the reversely bent portion is about one time to 1.2 times the width of each parallel portion.

According to another feature of the invention, the sheet metal strips, connected edge-to-edge by the hooked engagement of their extremal vertical edges, are additionally connected across their bottoms by a lower cross-connector or bar which can be rapped or tied to the rapping linkage and attached to the parallel portions or flattened crests by rivets, screws or the like.

The profiled portions of corresponding sheet metal strips of adjacent or opposing collecting electrode walls are preferably arranged in mirror symmetry. A corona electrode is advantageously disposed at the geometrical and electrical (electric field) center of the gas passage in each region in which two correspondingly profiled sheet metal strips are spaced the largest distance apart (i.e. where the troughs of the corrugations lie opposite one another). The inclined portions of adjacent collecting electrode walls are so oriented as to lie tangent to a circle or cylinder centered on the corona electrode.

In the design of dry-process dust-collecting electrostatic precipitators there is a trend toward wider gas passages, i.e. toward an arrangement of adjacent collecting electrodes with a center spacing of and above 500 millimeters whereas the gas passages had previously had a width in the range from 200 to 300 mm.

The combustion of inferior, low-sulfur coals in power plants having a capacity of and above 700 megawatts results in a production of high-resistance fine ash, which can be collected only with great difficulty and tends to form an effective insulating layer on the collecting electrodes so that reverse corona discharges are known to occur, whereby the separation efficiency is reduced.

This phenomenon can be almost entirely suppressed by the provision of wider gas passages; this requires a cleaning of the collecting electrodes by high-intensity rapping blows to ensure that the collecting electrodes will be cleaned as perfectly as possible. This requirement necessitates a rigid positive connection of each sheet metal strip of the collecting electrode directly to the rapping linkage. Besides, the contact surface area between each sheet metal strip and the rapping linkage must be sufficiently large so that rapping blows can be transmitted to the collecting electrodes with adequate intensity. Furthermore, the dust-collecting pockets must have a sufficiently large depth in relation to the width of the gas passage so that a raising of dust which has been collected will be avoided as far as possible. Moreover, the distribution of the electric field should be as homogeneous and uniform as posible so that the precipitator can be operated at a high voltage as that voltage will mainly determine the efficiency of separation of a dust-collecting electrostatic precipitator. Electrical flashovers tend to preferentially occur in regions in which the field has a high density and this effect will impose an upper limit for the voltage applied and will reduce the efficiency of separation.

The increase of the capacity of the plants from which dust is to be collected gives rise to a need for larger dust-collecting electrostatic precipitators so that it is conventional to provide collecting electrodes having a length of 15 meters and more. Owing to their large length, the sheet metal strips in contact with the gas stream tend to vibrate at their natural frequency under the action of the gas stream. Such vibration is prevented by the collector of the invention in that adjacent sheet metal strips are adequately hooked into each other at their vertical longitudinal edges. Local heating, e.g. by smoldering dust that has been collected, can result in deformations which are prevented or restricted by the interengagement of the edges. Finally, the sheet metal strips are identical and thus are adapted to be stacked in a nested arrangement in order to reduce their packaging, storage and transportation costs.

All of the requirements stated above are met when the collecting electrodes consist of sheet metal strips which are profiled in accordance with the invention; such profiling does not require a very high expenditure. In trials, sheet metal strips having the cross-sectional shape taught by the invention, within the ranges of dimensions given, have met all expectations regarding separation rate and reliability in operation.

BRIEF DESCRIPTION OF THE DRAWING

The above and other objects, features and advantages of the invention will become more readily apparent from the following description, reference being made to the accompanying drawing in which.

SPECIFIC DESCRIPTION

Figure 1:
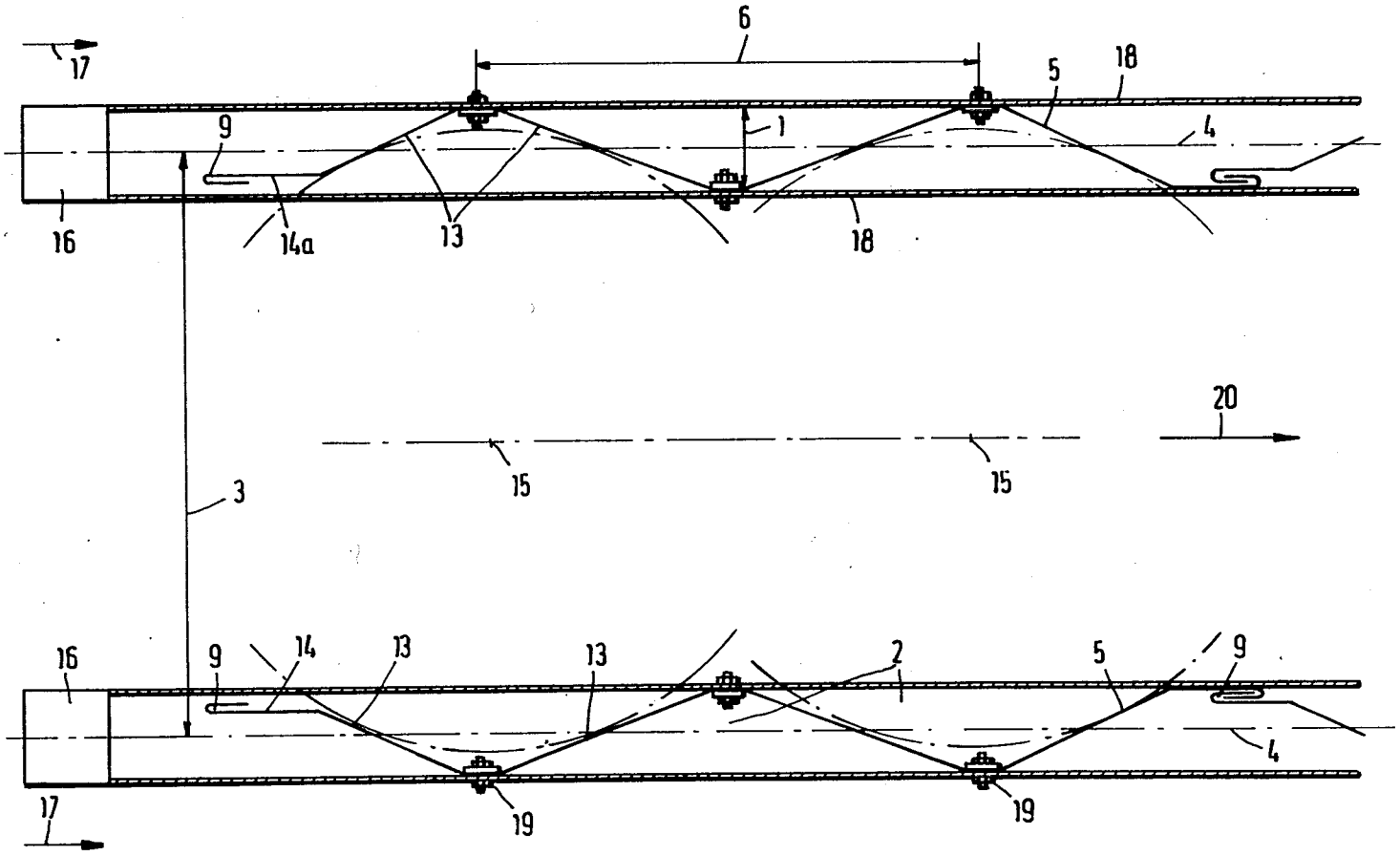
FIG. 1 is a fragmentary horizontal sectional view through an electrostatic precipitator and its electrode assembly, showing two adjacent or opposite collecting electrodes.

FIG. 1 shows a portion of a gas passage which is defined in a dust collector by two adjacent collecting electrodes. The center plane of each collecting electode is designated 4. Corona electrodes 15 are provided at the center of the gas passage and equally spaced from both center planes 4. A high d.c. voltage is applied by a suitable power supply across the corona and collecting electrodes.

Each collecting electrode consists of profiled sheet metal strips 5 which are formed with alternating dust-collecting pockets 2. Adjacent sheet metal strips 5 are hooked into each other at their vertical longitudinal edges 9 and are positively connected at 19 to the lower transverse connector 18.

This lower transverse connector 18 constitutes also a rapping linkage, to which striker 16 is secured. The arrows 17 indicate the direction of the rapping blows. The arrow 20 indicates the direction of gas flow.

Figure 3:
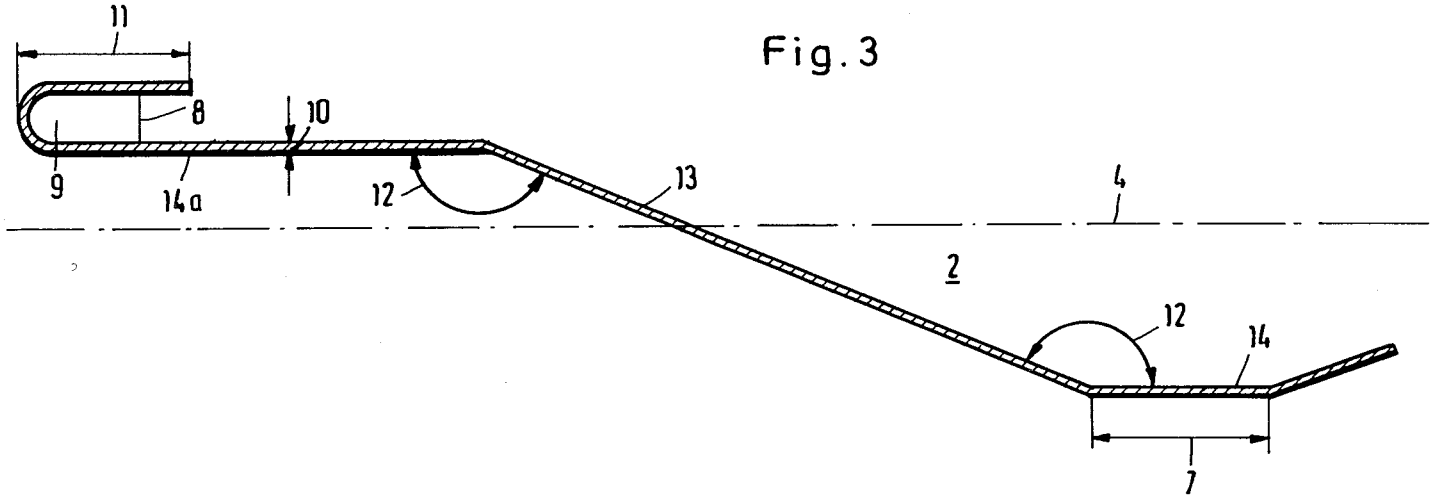
FIG. 3 is a fragmentary transverse sectional view showing on a larger scale a portion of an individual sheet metal strip.

In a practical embodiment of the invention, the profiled sheet metal strips 5 had the following characteristic dimensions. The perpendicular distance 1 between portions 14 which are parallel to the direction of gas flow 20 (see FIG. 3) or, in other words, the depth of each dust-collecting pocket, suitably amounts to 8 to 13% of the center spacing 3 of two adjacent collecting electrode walls. The spacing 6 of two adjacent apices facing in the same direction suitably amounts to 40 to 70% of the center spacing 3 of two adjacent collecting electrode walls.

Each parallel portion 14 disposed between two inclined portions 13 has a width 7 amounting to 8 to 13% of the center spacing 6 of two adjacent apices facing in the same direction.

The interior angle 12 between the inclined portions 13 of the sheet metal strips and the parallel portions 14, 14*a* should be at least 150°.

The clearance 8 defined by the reverse bend at the end of the strip is suitably four to five times the thickness 10 of the sheet metal strip 5. The vertical longitudinal edges will be effectively hooked into each other if the overall length 11 of the reverse bend is one to 1.2 times the width 7 of the parallel portions 14. All dimensional relations indicated above are apparent from FIG. 1 in conjunction with FIG. 3.

It is also shown in FIG. 1 that the profiles of the sheet metal strips of corresponding sheet metal strips 5 of adjacent collecting electrode walls are arranged in mirror symmetry and that a corona electrode 15 is disposed at the geometrical and electrical center of each gas passage in the region in which two corresponding profiled sheet metal strips 5 are spaced the largest distance apart, and that the inclined portions 13 of corresponding sheet metal strips of adjacent collecting electrode walls are tangent to a circle which is centered on the associated corona electrode 15.

Figure 2:
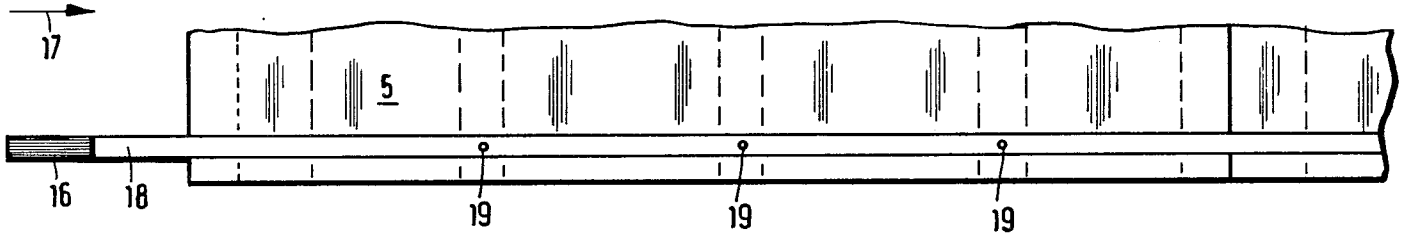
FIG. 2 is a side elevation showing the lower portion of a collecting electrode.

FIG. 2 is a side elevation showing how each sheet metal strip 5 is connected at 19 to the lower cross-connector 18, which carries the striker 16 for effecting rapping blows in the direction 17. As a result, the lower cross-connector 18 constitutes also the rapping linkage.

What is claimed is:

1. In a dust-collecting electrostatic precipitator having a plurality of parallel vertical spaced collecting electrodes defining gas passages between them adapted to be traversed by gas in a horizontal direction, each collecting electrode being formed by an array of contiguous profiled sheet metal strips which are substantially W-shaped in cross-section, an array of vertical corona discharge electrodes being disposed between pairs of said collecting electrodes, the improvement wherein:

(a) the strips comprise inclined portions which are inclined alternately in opposite directions with respect to the direction of gas flow, and between said inclined portions comprise parallel portions extending parallel to the direction of gas flow, whereby said portions define alternating crests and troughs;

(b) said strips have edge portions parallel to the direction of gas flow which at respective ends are reversely bent to form U-shaped hook strips, the hook strips of adjacent edge portions of successive strips of each collecting electrode being hooked together;

(c) the interior angles defined between the inclined portions and the parallel portions of the sheet metal strips are at least 150°;

(d) a perpendicular distance (1) between said parallel portions is 8 to 13% of a center spacing between two adjacent collecting electrode walls;

(e) a center distance of two consecutive crests on the same side of a collecting electrode is 40 to 70% of the center spacing of two opposing collecting electrodes;

(f) each parallel portion which is disposed between two inclined portions has a width of 8 to 13% of the center spacing of two crests on the same side;

(g) each reversely bent end portion defines a clearance which is four to five times the thickness of the sheet metal strip; and (h) an overall length of each reversely bent portion is about one times to 1.2 times the width of each parallel portion.

2. The improvement defined in claim 1 wherein the sheet metal strips are connected to a lower cross-connector adjacent to said parallel portions.

3. The improvement defined in claim 2 wherein profiled portions of corresponding sheet metal strips of opposing collecting electrodes are arranged in mirror symmetry.

4. The improvement defined in claim 3 wherein a respective one of said corona electrodes is diposed at a geometrical and electrical center of the gas passage in a region in which two corresponding profiled sheet metal strips are spaced the largest distance apart.

5. The improvement defined in claim 4 wherein the inclined portions of opposing collecting electrodes are tangent to a circle which is centered on the corona electrode.

* * * * *